United States Patent [19]

Baugh

[11] Patent Number: 5,071,126

[45] Date of Patent: Dec. 10, 1991

[54] TENNIS RACKET COVER AND BAG WITH MEASURING STRAP

[75] Inventor: James Baugh, Riverwoods, Ill.

[73] Assignee: Wilson Sporting Goods Co., River Grove, Ill.

[21] Appl. No.: 531,088

[22] Filed: May 31, 1990

[51] Int. Cl.[5] ..... A63B 49/18

[52] U.S. Cl. ..... 273/74; 150/163; 206/315.1

[58] Field of Search ..... 273/74, 29 B, 29 BA, 273/29 R, 73 R; 150/163; 206/315.1

[56] References Cited

U.S. PATENT DOCUMENTS

| | | | |
|---|---|---|---|
| D. 238,214 | 12/1975 | Rivera | 150/163 |
| 1,091,280 | 3/1914 | Brauer | 273/74 |
| 2,134,411 | 10/1938 | Marx | 273/74 X |
| 2,197,977 | 4/1940 | Halpin | 273/29 R |
| 2,767,758 | 10/1956 | Haynes | 206/315.1 |
| 3,963,103 | 6/1976 | Cowen | 206/315.1 |
| 4,205,840 | 6/1980 | Blevins | 273/29 BA |
| 4,671,510 | 6/1987 | Schoenwetter | 273/74 X |

FOREIGN PATENT DOCUMENTS

| | | | |
|---|---|---|---|
| 1029898 | 6/1953 | France | 273/74 |
| 630837 | 10/1949 | United Kingdom | 273/74 |

*Primary Examiner*—Edward M. Coven
*Assistant Examiner*—William E. Stoll

[57] ABSTRACT

A tennis racket cover is provided with a measuring strap for measuring the height of a tennis net. A first end of the strap is attached to the cover, and a second end of the strap can be pulled away from the cover and positioned beyond a first end of the cover. The distance between a second end of the cover and the second end of the strap is about 36 inches.

7 Claims, 1 Drawing Sheet

FIG. 2
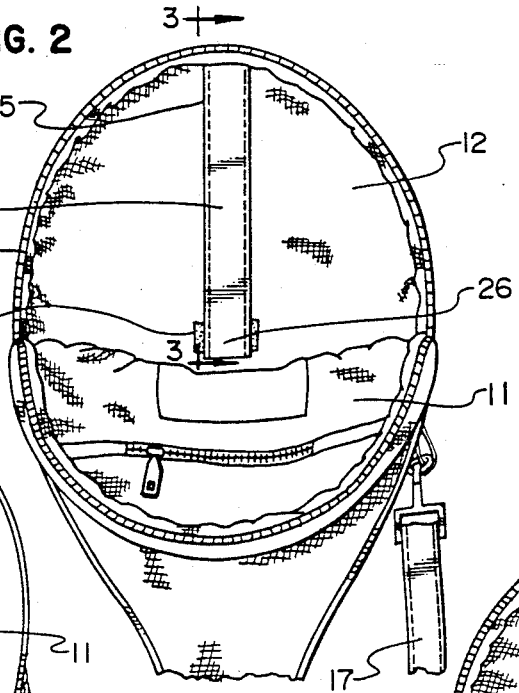
FIG. 1
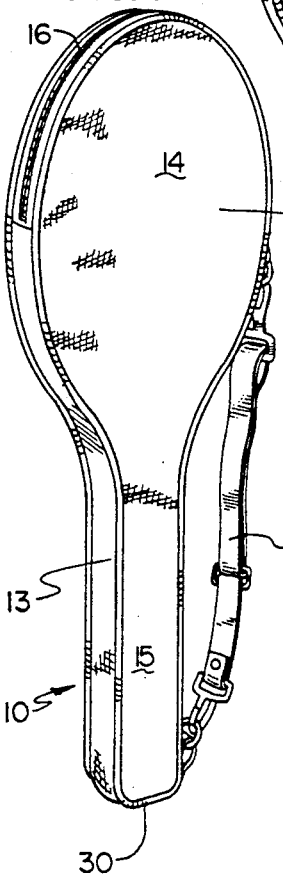
FIG. 4
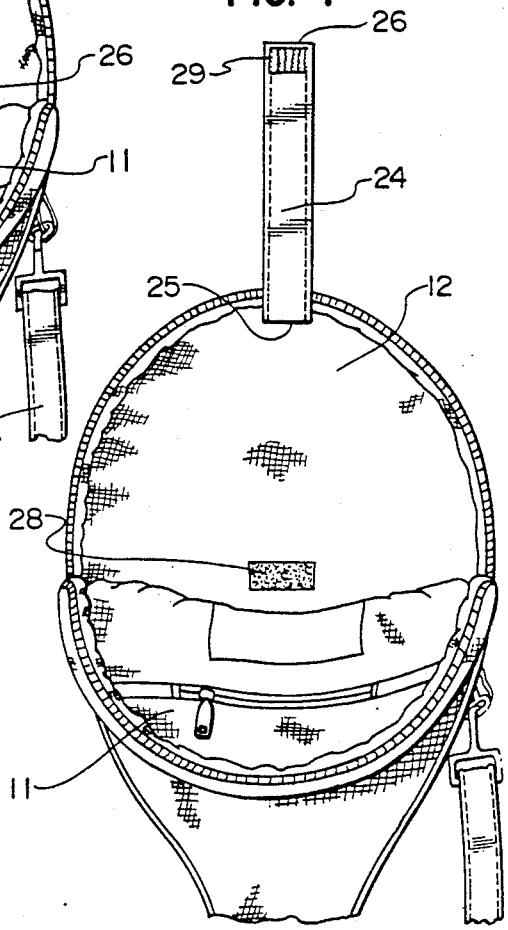
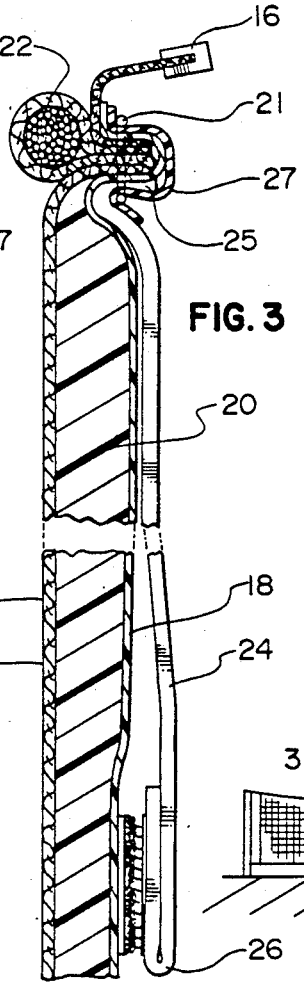
FIG. 3
FIG. 5
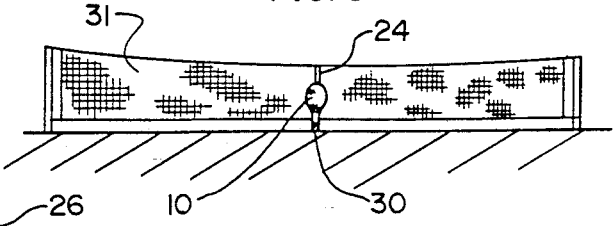

TENNIS RACKET COVER AND BAG WITH MEASURING STRAP

Background

This invention relates to a measuring device for a tennis net, and, more particularly, to a measuring device which is incorporated into a cover for a tennis racket.

The standard height of a tennis net at the center of the net is 36 inches. The support posts for the net at the sides of the tennis court are higher than 36 inches, and the center of the net is pulled down to a height of 36 inches by a strap which is secured to the tennis court. The tension of the strap should be adjusted periodically to ensure that the height of the center of the net is correct.

In order to avoid the necessity of carrying a yardstick or other measuring instrument, various measuring devices have been provided as part of conventional tennis equipment. For example, for a long time tennis rackets have been provided in a standard length of 27 inches, and a standard head width of 9 inches. Players could measure the height of the net by utilizing the length of one racket and the head width of a second racket.

Rackets in recent years have been provided with various sized heads or strung surfaces. For example, head sizes are generally grouped within the terms large size, midsize, and standard size. The length of current rackets might also be more or less than 27 inches. Accordingly, it is not always possible to use the length and head width of current tennis rackets to measure the net.

U.S. Pat. No. 4,712,795 describes a tennis racket which is provided with a mark so that a pair of rackets can be combined in a way that the distance from the end of one racket to the mark on another racket is 36 inches. However, the procedure described in the patent requires either two identical rackets or at least one racket having a known length.

Other measuring devices have utilized other items of tennis equipment, for example, the shoulder strap of a tennis carrying case. However, those devices generally require some adjustment of the device before it can be used for measuring.

SUMMARY OF THE INVENTION

The invention provides a measuring device which is incorporated as part of a tennis racket cover. A strap is attached to the inside of the cover so that the strap is not visible when it is not being used. One end of the strap is permanently attached to the inside of the cover, and when the strap is pulled away from one end of the racket cover, the distance between the end of the racket cover and the free end of the strap is 36 inches without the need for any adjustment. The free end of the strap can be removably retained in a storage position inside the cover by hook and loop fasteners on the strap and on the cover. The length of the measuring device is independent of the total length of the cover, and the cover can be used with rackets of various sizes.

DESCRIPTION OF THE DRAWING

The invention will be explained in conjunction with an illustrative embodiment shown in the accompanying drawing, in which:

FIG. 1 is a perspective view of a tennis racket cover which is equipped with a measuring strap in accordance with the invention;

FIG. 2 is an enlarged fragmentary front elevational view showing one of the panels of the cover folded downwardly;

FIG. 3 is a sectional view taken along the line 3—3 of FIG. 2;

FIG. 4 is a view similar to FIG. 2 showing the measuring strap in the measuring position; and FIG. 5 illustrates the cover being used to measure the height of a tennis net.

DESCRIPTION OF SPECIFIC EMBODIMENT

Referring to FIG. 1, a tennis racket cover and bag 10 comprises a casing provided by front and rear panels 11 and 12 and a side panel 12 which is stitched or otherwise secured to the panels 11 and 12. If desired, the front and rear panels can be secured directly to each other. Each of the front and rear panels has the shape of a tennis racket and includes an oval top portion 14 which is sized to enclose the head of a tennis racket and an elongated narrow bottom portion 15 which encloses the handle of a tennis racket. A zipper 16 is provided in the side panel 13 for inserting and removing the tennis racket. A shoulder strap 17 may be used to facilitate carrying the racket.

The panels 11–13 can be made from any suitable material, for example fabric, vinyl, etc. Referring to FIG. 3, the panel 12 includes inner and outer layers 18 and 19 of sheet material which enclose padding 20. The inner and outer layers are stitched together at the peripheries by stitching 21, which also attaches the zipper 16. A roll or bead 22 is secured within a looped portion of the sheet 19 by the stitching. The cover can be sized to enclose a particular size of tennis racket, for example, a large head or a midsize, or the cover can be big enough to be used for any size of racket.

The cover which has been described is conventional, and the measuring strap of the invention can be used with any conventional cover.

Referring to FIGS. 2–4, a measuring strap 24 has a pair of ends 25 and 26. The end 25 is secured to the inside surface of the panel 12 adjacent the top end thereof. The strap can be secured by any suitable means, such as stitching, adhesive, rivets, etc. In the embodiment illustrated the strap is secured by the stitching 21 and a cover strip 27. The end 26 of the strap can remain unsecured, but in the preferred embodiment the end 26 is detachably secured to the panel 12 by a hook and loop fastener of the type which is sold under the trademark VELCRO. A hook or loop pad 28 is secured to the panel 12, and a complementary pad 29 is attached to the strap adjacent the end 26.

When the measuring strap is not being used, it is secured in a storage position inside of the racket cover as illustrated in FIG. 2. The strap is not visible from outside of the racket, and the strap does not interfere with inserting or removing the tennis racket.

When the measuring strap is used to measure the height of a tennis net, the hook and loop pads 28 and 29 are detached, and the strap is extended upwardly through the zipper opening to a measuring position illustrated in FIGS. 4 and 5.

The length of the measuring strap and the point of attachment of the fixed end 25 are selected so that the distance between the bottom end 30 of the cover and the free end 26 of the strap in the measuring position is 36 inches or approximately 36 inches. The strap need not be secured at any particular location on the head portion of the panel 12 so long as the length of the strap provides a total measuring distance of 36 inches. Accordingly, the measuring distance is independent of the length of the racket cover, and the measuring strap can be used with any size cover.

FIG. 5 illustrates the measuring device being used to measure the height of the center of a tennis net 31. The bottom end 30 of the racket cover is held against the surface of the tennis court, and the measuring strap 24 is pulled upwardly. The height of the tennis net is adjusted until it is level with the upper end 26 of the measuring strap. The measuring strap provides an immediate reference point for the net without any adjustment since the position of the fixed end 25 is selected by the manufacturer to provide a total length of 36 inches from the bottom end of the racket cover to the free end of the strap.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A cover for a tennis racket comprising:

a casing for enclosing a racket, the casing having first and second ends, a handle portion for enclosing a handle of a tennis racket, and a head portion for enclosing a head of a tennis racket, and a strap having first and second ends, the first end of the strap being attached to the casing, the strap being movable between a storage position in which the second end of the strap is positioned within the periphery of the casing and a measuring position in which the second end of the strap extends beyond the first end of the casing and the distance between the second end of the strap and the second end of the casing is about 36 inches.

2. The cover of claim 1 in which the casing includes a pair of panels which are connected along their peripheries to form an enclosure for a tennis racket, each of the panels having inside and outside surfaces, said strap being attached to the inside surface of one of the panels.

3. The cover of claim 2 in which said first end of the casing is in the head portion of the casing and said second end of the casing is in the handle portion of the casing, said strap being attached to the head portion of the casing.

4. The cover of claim 3 including means on said casing and on the second end of said strap for removably attaching the second end of the strap to the casing.

5. The cover of claim 4 in which said attaching means comprises complementary hook and loop fasteners on the casing and on the second end of the strap.

6. The cover of claim 1 including means on said casing and on the second end of said strap for removably attaching the second end of the strap to the casing.

7. The cover of claim 6 in which said attaching means comprises complementary hook and loop fasteners on the casing and on the second end of the strap.

* * * * *